US006141990A

United States Patent [19]

De Bussy et al.

[11] Patent Number: 6,141,990

[45] Date of Patent: Nov. 7, 2000

[54] PROCESS AND PLANT FOR SEPARATING AIR BY CRYOGENIC DISTILLATION

[75] Inventors: Francois De Bussy, Paris; Lasad Jaouani, Bobigny, both of France

[73] Assignees: Air Liquide America Corporation, Houston, Tex.; L'Air Liquide Societe Anonyme pour L'Etude et L'Exploitation des Percedes Georges Claude, Paris, France

[21] Appl. No.: 09/265,833

[22] Filed: Mar. 10, 1999

[30] Foreign Application Priority Data

Mar. 11, 1998 [FR] France ..... 98 02977

[51] Int. Cl.[7] ..... F25J 3/00

[52] U.S. Cl. ..... 62/647

[58] Field of Search ..... 62/643, 646, 647

[56] References Cited

U.S. PATENT DOCUMENTS

| | | | |
|---|---|---|---|
| 3,260,056 | 7/1966 | Becker | 62/643 |
| 5,355,682 | 10/1994 | Agrawal et al. . | |
| 5,511,381 | 4/1996 | Higginbotham | 62/646 |
| 5,704,229 | 1/1998 | Coakley et al. | 62/646 |

FOREIGN PATENT DOCUMENTS

| | | |
|---|---|---|
| 0 093 448 | 11/1983 | European Pat. Off. . |
| 0 745 817 | 12/1996 | European Pat. Off. . |
| 33 07 181 | 9/1984 | Germany . |

*Primary Examiner*—William Doerrler
*Attorney, Agent, or Firm*—Young & Thompson

[57] ABSTRACT

In order to allow more flexible operation of a column for separating air by cryogenic distillation, a first air stream (6) exchanges heat with a liquid (16) which vaporizes, while a second air stream (7, 7A) is drawn off from an intermediate level in the exchange line and sent to a column in order to be distilled therein.

16 Claims, 4 Drawing Sheets

PROCESS AND PLANT FOR SEPARATING AIR BY CRYOGENIC DISTILLATION

Figure 1:
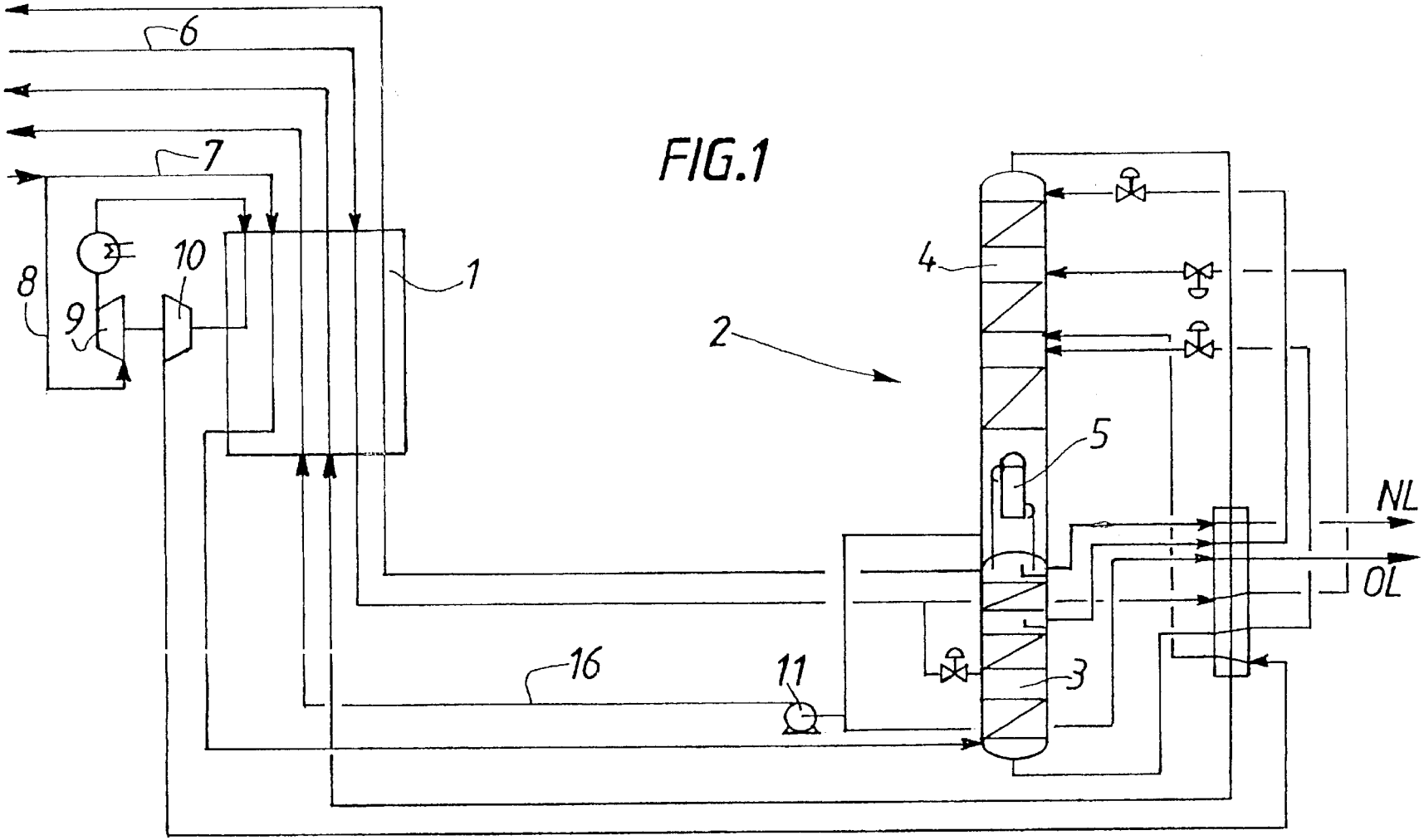

The present invention relates to a process and a plant for separating air by cryogenic distillation.

In order to produce a gas from pressurized air, it is known to draw off a liquid from an air distillation column, to pressurize it and to vaporize it in the main exchange line of the plant, thus allowing gas to be produced at a higher pressure than that in the column.

FR-A-2,674,011 describes a process in which the air to be distilled is divided into two parts, the first part being liquefied in the exchange line counter to a liquid product which vaporizes, and the second part being cooled down to an intermediate level of the exchange line before being expanded in a Claude turbine and sent to the medium-pressure column.

FR-A-2,711,778 describes a pump process in which three air streams are sent to the medium-pressure column. One of these streams comes from a Claude turbine. The other two streams pass right through the exchange line; one of the streams is thus liquefied while the other leaves the exchange line at its dew point.

These two streams leaving the cold end of the exchange line are therefore approximately at the same temperature.

In a number of cases, this temperature equality constraint prevents the medium-pressure column from operating optimally.

The higher-pressure stream which is liquefied is expanded and undergoes a flash step on entering the medium-pressure column. The lower-pressure stream leaving the cold end of the exchange line sometimes contains a liquid fraction. Consequently, the lower portion of the medium-pressure column does not operate optimally, because of too cold a bottom feed and/or too warm a top feed.

One object of the present invention is for there to be an additional degree of freedom with regard to the temperatures of the air streams which feed the columns, allowing the columns to operate optimally.

According to one object of the invention, provision is made for a process for separating air by cryogenic distillation in a plant comprising a column system in which:

a) at least two air streams are cooled in an exchange line and are sent to the column system, b) the air is separated in a column of the system into an oxygen-enriched fraction and a nitrogen-enriched fraction, c) a liquid stream is drawn off from a column of the system and vaporizes in the exchange line, d) a first air stream exchanges heat in the heat-exchange line with the liquid which vaporizes, e) a second air stream is drawn off from an intermediate level in the exchange line, characterized in that the second air stream is sent from the exchange line to a column of the system without being expanded.

According to other aspects of the invention, a third stream of air is drawn off, optionally from an intermediate level in the exchange line downstream or upstream of the level from which the second air stream is drawn off, the third air stream is sent from the exchange line to the column system, optionally without being expanded, the third stream is controlled by a valve, at least part of the first stream is liquefied and sent to a column of the plant, part (or all) of the first liquefied stream is expanded in a turbine.

According to another object of the invention, provision is made for a plant for separating air by air distillation, comprising:

a column system, means for sending a first air stream and a second air stream to an exchange line and from the exchange line to the column system, means for sending at least one pressurized liquid coming from the column system to the exchange line, means for drawing off the second air stream from an intermediate level in the exchange line, characterized in that it comprises means for sending the second stream from the intermediate level in the exchange line to the medium-pressure column, these means not comprising means for expanding the stream.

According to other aspects of the invention, the plant comprises means for sending a third air stream, which cools in the exchange line, and means for drawing off this third stream upstream or downstream of the point from which the second stream is drawn off, means for sending the third stream to a medium-pressure column, these means not comprising expansion means, an argon column fed with a stream coming from the low-pressure column.

Examples of how the invention is implemented will now be described with reference to the appended drawings, in which FIGS. 1 to 4 show diagrammatically four embodiments of the air distillation plant according to the invention.

The air distillation plant shown in FIG. 1 is designed to produce liquid nitrogen, liquid oxygen and gaseous oxygen with a purity of 99.5% at a pressure substantially above 1 bars, for example at 40 bar and possibly being as high as 100 bar or more.

The plant essentially comprises a heat-exchange line 1, a double distillation column 2, which itself comprises a medium-pressure column 3, a low-pressure column 4 and a condenser-boiler 5. The columns 3 and 4 operate at 6 and 1.2 bars, respectively.

A first air stream 6, at 70 bars, is sent to the exchanger 1 where it is liquefied. Next, it is divided into two fractions in order to supply the reflux at the low-pressure and medium-pressure columns.

A second air stream 7, at 6 bars, is sent to the exchanger but only goes through part of it. Drawn off from the exchanger, it is sent to the bottom of the medium-pressure column.

Another air stream 8, at 6 bars, is pressurized in the supercharger 9, cooled in the exchanger 1, drawn off from a level upstream of the level from which the second stream is drawn off, expanded in a blowing turbine 10 coupled to the supercharger and sent to the low-pressure column 4.

Lean liquid and rich liquid are sent from the medium-pressure column 3 to the low-pressure column 4.

Liquid oxygen, a part of which is used for liquid production, is drawn off from the bottom of the low-pressure column. The rest 16 is pressurized by a pump 11 and vaporizes in the exchanger 1. Nitrogen streams coming from the double column are also warmed in this exchanger.

Figure 2:
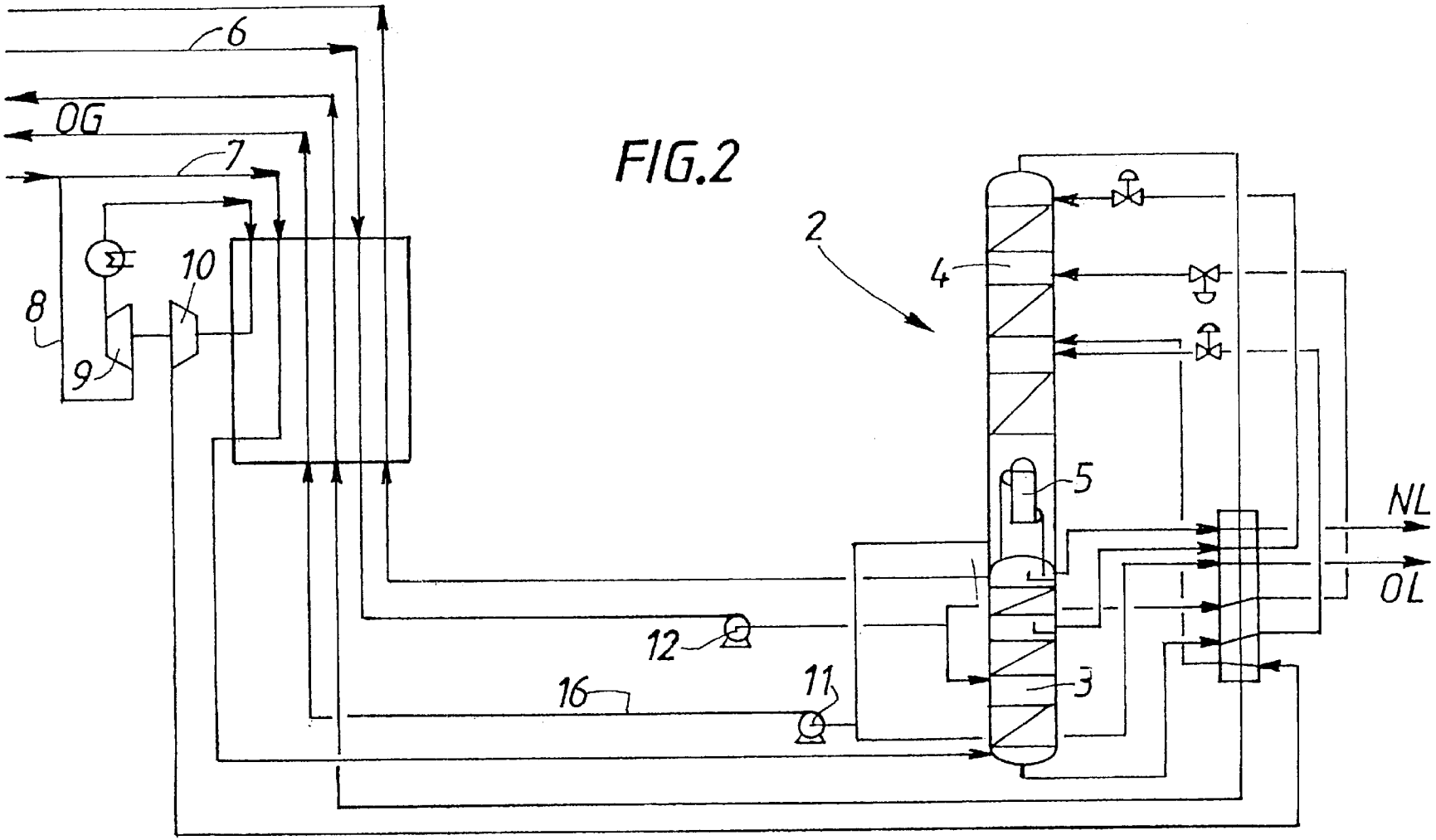

Alternatively, as may be seen in FIG. 2, the liquefied air 6 may be expanded in a hydraulic turbine 12 before being sent to the columns of the double column.

Figure 3:
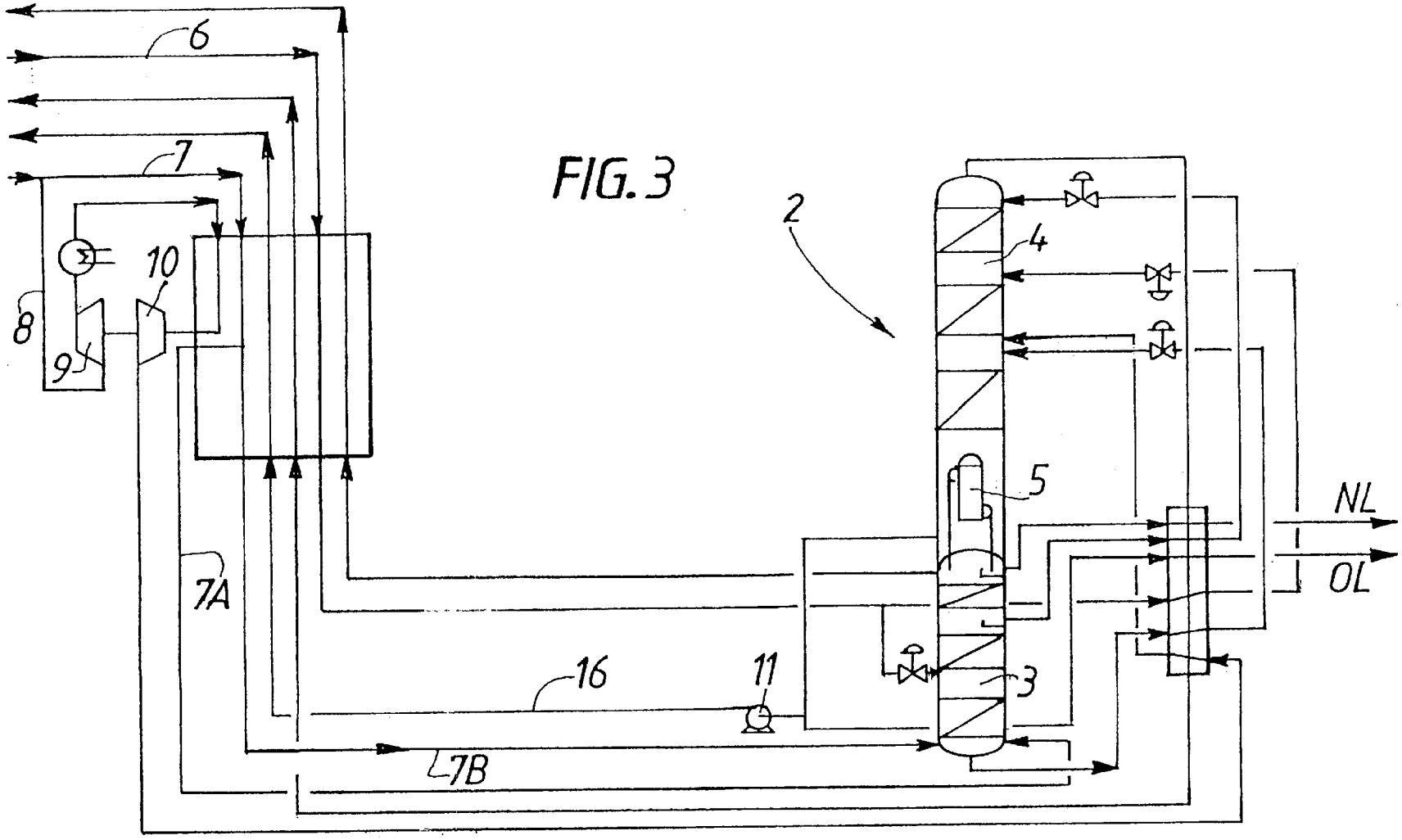

In FIG. 3, the second stream 7 is divided into two streams 7A, 7B. Whereas the stream 7A is drawn off from an intermediate level in the exchanger 1, the stream 7B passes right through the exchanger and leaves from the cold end. The two streams are sent to the medium-pressure column. The stream 7A is controlled by a valve.

Figure 4:
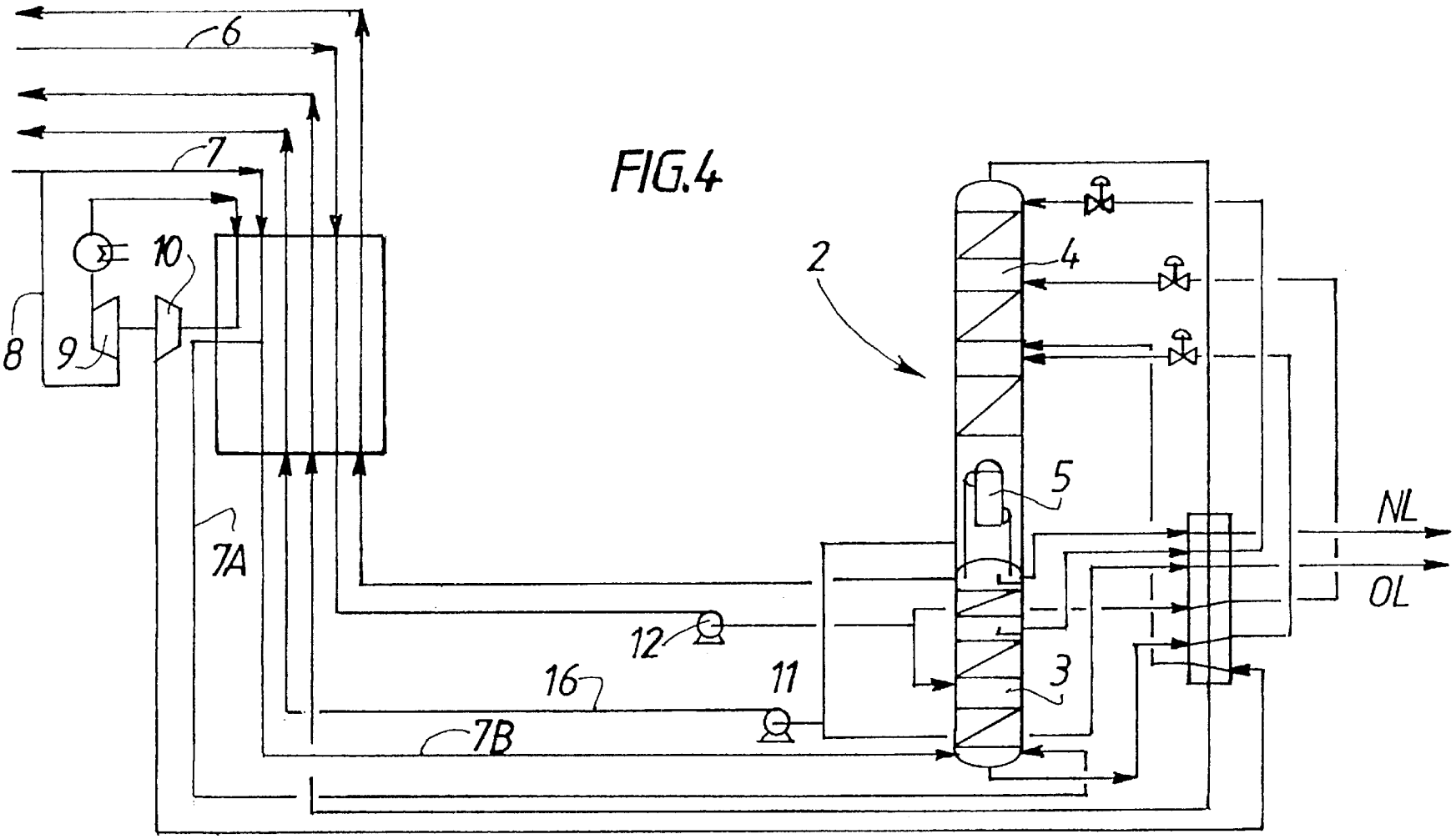

This figure may be modified, as in FIG. 1, to comprise a hydraulic turbine 12 (see FIG. 4).

By replacing the blowing turbine 10 with a Claude turbine, which would for example be fed with a fraction of the first HP air stream drawn off from the exchange line at an intermediate temperature or with another air stream at a pressure above that of the second air stream, the process is well suited to the production of pure argon using an argon column fed from the low-pressure column 4.

Obviously, the pressurized liquid vaporized in the exchange line may be liquid nitrogen or liquid argon.

Several liquids may vaporize in this exchange line at the same time.

If the stream 6 is at a supercritical pressure, it is not liquefied in the exchange line.

What is claimed is:

1. Process for separating air by cryogenic distillation in a plant comprising a column system in which:

a) at least two air streams (6, 7, 7A) are cooled in an exchange line (1) and are sent to a column (3) of the system, b) the air is separated in the column into an oxygen-enriched fraction and a nitrogen-enriched fraction, c) a liquid stream (16) is drawn off from a column (4) of the system and vaporizes in the exchange line, d) a first air stream (6) exchanges heat in the heat-exchange line with the liquid which vaporizes, e) a second air stream (7, 7A) is drawn off from an intermediate level in the exchange line, characterized in that the second air stream is sent from the exchange line to the column system without being expanded.

2. Process according to claim 1, in which a third air stream (7B) is drawn off, optionally from an intermediate level in the exchange line downstream or upstream of the level from which the second air stream is drawn off.

3. Process according to claim 2, in which the third air stream is sent from the exchange line to the column without being expanded.

4. Process according to claim 1, in which at least part of the first stream (6) is liquefied and sent to a medium-pressure column and/or to a low-pressure column of a double column.

5. Process according to claim 4, in which part (or all) of the first liquefied stream is expanded in a turbine (12).

6. Plant for separating air by air distillation, comprising:

a column system (2), means for sending a first air stream (6) and a second air stream (7, 7A) to an exchange line (1) and from the exchange line to a column, means for sending at least one pressurized liquid (16) coming from the double column to the exchange line, means for drawing off the second air stream (7, 7A) from an intermediate level in the exchange line, characterized in that it comprises means for sending the second stream from the intermediate level in the exchange line to the medium-pressure column, these means not comprising means for expanding the stream.

7. Plant according to claim 6, in which the first air stream (6) is cooled down to the cold end of the exchange line.

8. Plant according to claim 6, comprising means for sending a third air stream (7B), which cools in the exchange line, and means for drawing off this third stream upstream or downstream of the point from which the second stream is drawn off.

9. Plant according to claim 8, comprising means for sending the third stream (7B) to a medium-pressure column of a double column, these means not comprising expansion means.

10. Plant according to claim 6, comprising an argon column fed with a stream coming from a low-pressure column of a double column.

11. Plant according to claim 7, comprising means for sending a third air stream (7B), which cools in the exchange line, and means for drawing off this third stream upstream or downstream of the point from which the second stream is drawn off.

12. Plant according to claim 7, comprising an argon column fed with a stream coming from a low-pressure column of a double column.

13. Process according to claim 1, in which said column system comprises a medium pressure column and a low pressure column and the said first air stream enters said medium pressure column at a higher point than said second air stream.

14. Process according to claim 1, wherein said column system comprises a medium pressure column and a low pressure column each containing liquid-vapor mass transfer structure and said second air stream enters said medium pressure column below said liquid-vapor mass transfer structure.

15. Plant according to claim 6, wherein said first air stream enters said medium pressure column at a higher point than said second stream.

16. Plant according to claim 6, wherein said medium pressure column contains liquid-vapor mass transfer structure and said second stream enters said medium pressure column below said liquid-vapor mass transfer structure.

* * * * *